US005312288A

United States Patent [19]

Williams

[11] Patent Number: 5,312,288

[45] Date of Patent: May 17, 1994

[54] STEERING SYSTEM FOR TOY VEHICLE

[76] Inventor: Larry C. Williams, 7731 Rutland, Detroit, Mich. 48228

[21] Appl. No.: 858,843

[22] Filed: Mar. 27, 1992

[51] Int. Cl.[5] ..... A63H 17/36

[52] U.S. Cl. ..... 446/468; 446/466

[58] Field of Search ..... 446/468, 466, 460, 465, 446/451

[56] References Cited

U.S. PATENT DOCUMENTS

| | | | |
|---|---|---|---|
| 1,730,296 | 10/1929 | Richter | 446/468 |
| 2,386,745 | 10/1945 | Yarbrough | 446/468 |
| 2,946,153 | 7/1960 | Ernst . | |
| 3,144,731 | 8/1964 | Jones et al. | 446/466 |
| 3,474,564 | 10/1969 | Perryman . | |
| 3,581,435 | 6/1971 | Wingrove | 446/468 C |
| 3,635,304 | 1/1972 | Hills | 446/468 X |
| 3,696,554 | 10/1972 | Dorn | 446/468 |
| 4,595,380 | 6/1986 | Magers | 446/451 |

FOREIGN PATENT DOCUMENTS

| | | | |
|---|---|---|---|
| 693323 | 8/1964 | Canada | 446/468 |
| 861526 | 1/1953 | Fed. Rep. of Germany | 446/468 |
| 2713578 | 10/1978 | Fed. Rep. of Germany | 446/468 |
| 892176 | 3/1962 | France | 446/468 |

*Primary Examiner*—Mickey Yu

*Attorney, Agent, or Firm*—Dykema Gossett

[57] ABSTRACT

An improved steering mechanism for toy vehicles is disclosed wherein an operator merely pushes downwardly on one lateral side of the vehicle, and the vehicle is caused to turn to that side. The invention incorporates a simplified steering system, wherein an elongate member rotates with the vehicle cab, and causes the front wheels to move to a location such that the vehicle will turn in the desired direction.

12 Claims, 3 Drawing Sheets

STEERING SYSTEM FOR TOY VEHICLE

BACKGROUND OF THE INVENTION

This application in general relates to a toy vehicle which may be easily steered.

In the prior art, toy vehicles are often not steerable. Prior art toy vehicles that are steerable are cumbersome and difficult to use. Often, relatively complex manipulation is required to steer the vehicle. A child typically uses toy vehicles and it would be desirable that the toy vehicle be easy to steer. Further, the vehicles may often not easily turn when being pushed at a relatively high rate of speed.

Thus, it is an object of the present invention to disclose a vehicle which may be easily steered by a child. Further, it is an object of the present invention to disclose a toy vehicle which turns easily when being pushed at a relatively high rate of speed.

SUMMARY OF THE INVENTION

In a disclosed embodiment of the present invention, an elongate member is fixed to rotate with a vehicle cab. The vehicle cab is positioned over a vehicle base, and wheels are mounted to the base. The elongate member rotates with the vehicle cab, and is connected to a steering mechanism for the front wheels such that upon rotation of the cab, the front wheels are moved to positions that cause the vehicle to turn.

In a preferred embodiment of the present invention, the front wheels are steerable. More preferably, a lever is fixed to a side of the elongate member removed from the cab. When the cab is turned to right or left by a user, the elongate member rotates, and the lever rotates in the opposite direction to the cab. Thus, when a user of the toy vehicle pushes downwardly on the right side of the cab, the lever moves upwardly and to the left. The steering mechanism of the present invention is caused to move the front wheels such that the vehicle will turn to the right.

A user of the toy vehicle may thus easily turn the vehicle without any complicated movements. By merely applying force to the side of the cab to which the user wishes the vehicle to turn, the vehicle will be adjusted to turn to that side. More preferably, a tie-rod is connected to the lever and is connected to a flange which is fixed to pivot relative to the base and turn the wheel. The tie-rod is preferably connected to both the lever and the flange with a universal joint such that the different axes of movement of the wheel and lever are accommodated.

More preferably, a bias system returns the elongate member back to its original center position. In a most preferred embodiment of the present invention, the bias system includes a pair of coil springs attached to a plate fixed between the elongate member and the cab. When the cab is forced downwardly to the right or left, it compresses one of the two coil springs. Upon relaxation of this force, the coil springs move back to a relaxed length, centering the plate and consequently the elongate member. The steering mechanism thus adjusts such that the vehicle again begins moving forwardly.

The only required manipulation to turn the vehicle is thus the application of a downward force to one side of the cab. A user is able to apply this force easily, even when pushing the vehicle at a relatively high rate of speed.

These and other features of the present invention will be best understood from the following specification and drawings, of which the following is a brief description.

DETAILED DESCRIPTION OF A PREFERRED EMBODIMENT

Figure 1:
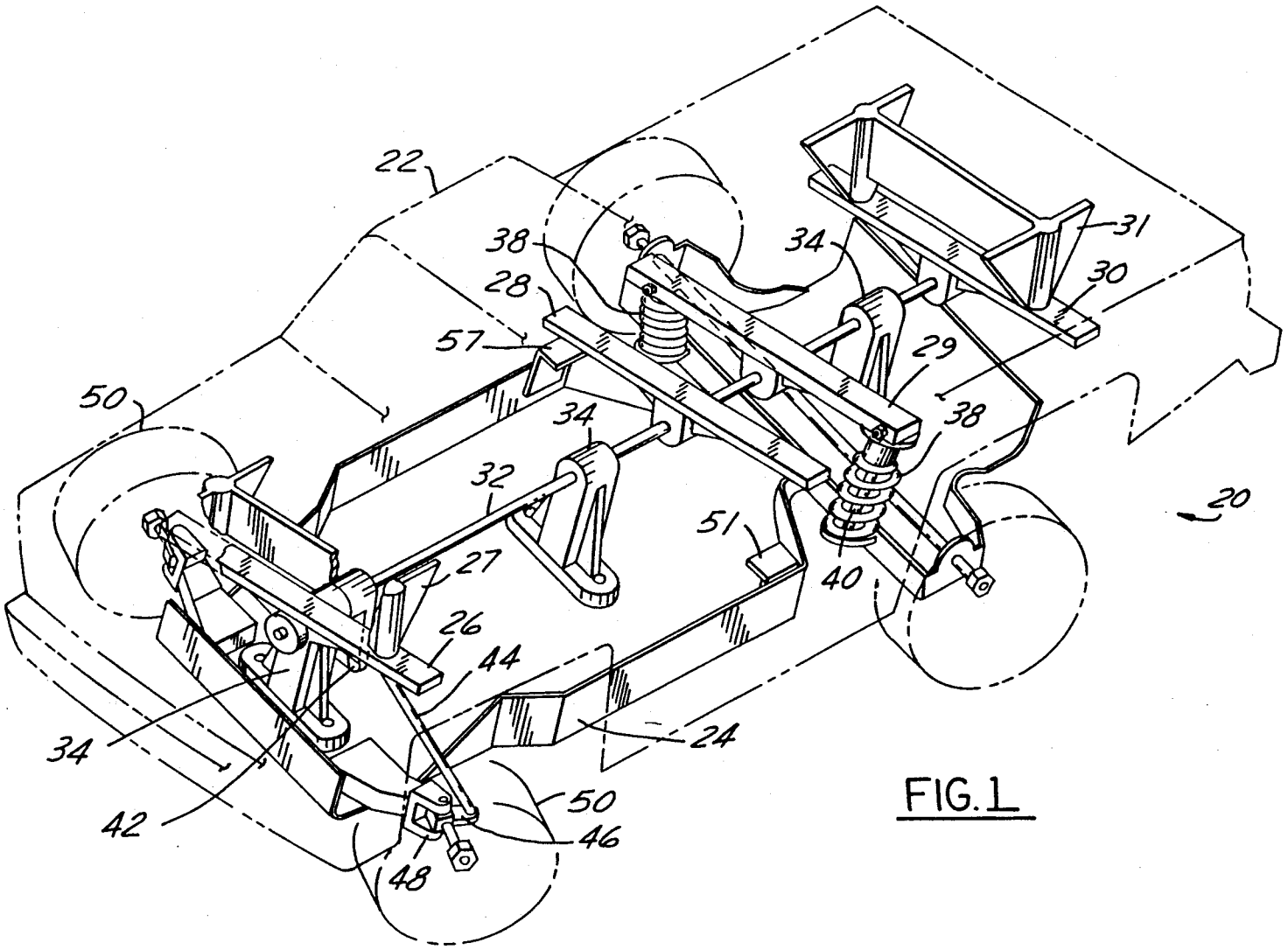
FIG. 1 is a perspective view of a toy vehicle incorporating the present invention.

A toy vehicle 20 is shown in FIG. 1 having a cab 22, shown in phantom, mounted above a base 24. In one preferred embodiment, cab 22 is not directly fastened to base 24, but may pivot about a central longitudinal axis of base 24. To this end, plate 26 is fixed by bosses 27 to an under face of cab 22. Similarly, plates 28 and 29 are fixed to an underside of cab 22 and a rear plate 30 is also fixed by boss 31 to an under face of cab 22.

An elongate rod 32 is fixed to rotate with plates 26, 28, 29 and 30, and consequently with vehicle cab 22. Rod 32 is mounted in bearings 34 at spaced locations along base 24. A pair of centering bias coil springs 38 are mounted on rods 40, and bias plate 29 towards a centered position.

A lever 42 rotates with rod 32, and is fixed to tie-rods 44 which in turn are fixed to flanges 46. Flanges 46 pivot within bracket 48 to turn wheels 50. A similar arrangement is used for both front wheels 50.

When a user of toy vehicle 20 pushes downwardly on the right side of cab 22, rod 32 rotates counter-clockwise as viewed from the front of vehicle 20. Lever 42 would also rotate counter clockwise. This causes the left tie-rod 44 to be forced upwardly and outwardly, causing flange 46 associated with the left wheel 50 to be pivot outwardly, causing the left wheel 50 to also pivot outwardly. At the same time, a similar tie-rod 44 and flange 46 causes the right front wheel 50 to pivot inwardly to the position shown in this figure. In this location, front wheels 50 would cause toy vehicle 20 to turn to the right. As shown, the right coil spring 38 is compressed. Stop 51 limit the movement of plates 28.

Thus, a user of toy vehicle 20 merely pushes downwardly on one side of the vehicle to cause the vehicle to turn. The vehicle will then adjust and turn to that side. Once this downward force is removed, the compressed coil spring 38 extends to its relaxed length, and plate 29 is centered. As this occurs, the other plates 26, 28 and 30, and rod 32 will be returned to their centered position. This brings tie-rods 44 back to a centered position, and returns wheels 50 to a straight forward position.

Figure 2:
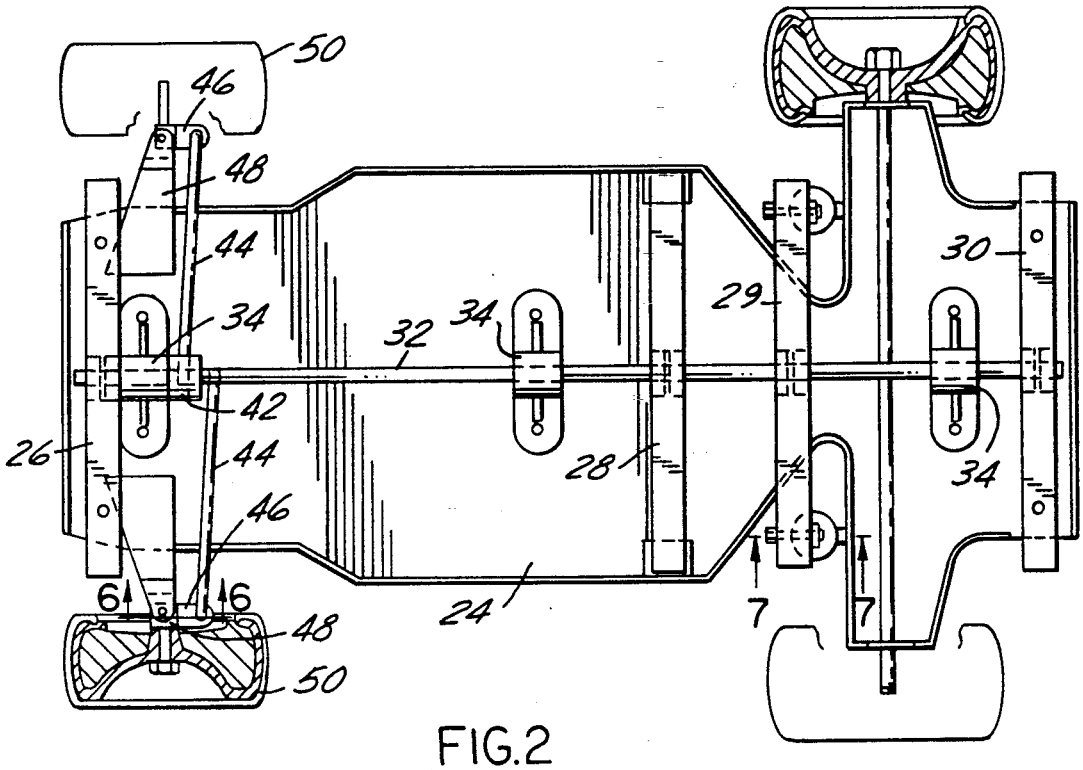
FIG. 2 is a top view of a portion of the vehicle shown in FIG. 1.

As shown in FIG. 2, one tie-rod 44 is mounted on a forward face of lever 42, while a second rod 44 is mounted on a rearward face. Further, the bearings 34 are mounted at three spaced locations on base 24.

Figure 3:
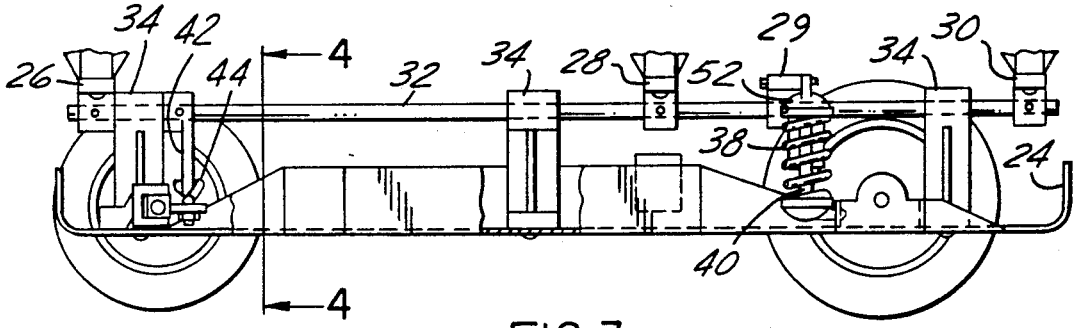
FIG. 3 is a side view of the portion shown in FIG. 2.

As shown in FIG. 3, lever 42 extends downwardly from rod 32, which is in turn spaced downwardly from the cab, not shown in this figure. Thus, lever 42 rotates in an opposed direction from the cab, when the cab is rotated to turn the vehicle. This causes the steering mechanism to adjust to the proper location to turn the vehicle in the desired direction.

As further shown in FIG. 3, spring 38 is mounted on a member 52 which moves with plate 29, and slides on rod 40. When plate 29 rotates with rod 32, one of the coil springs 38 is compressed by member 52 moving downwardly. As described above, once this force is removed, coil spring 38 will move back to its relaxed position, returning the members to centered locations.

Figure 4:
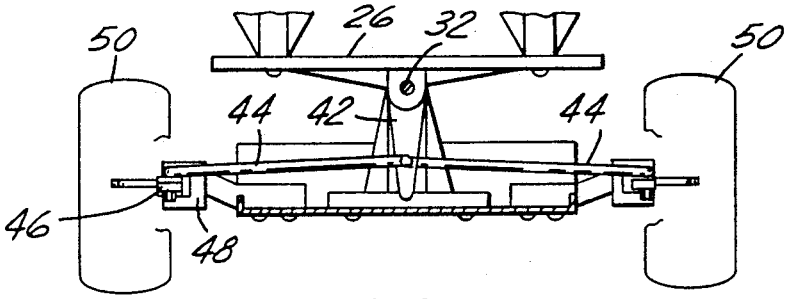
FIG. 4 is a cross-sectional view along line 4—4 as shown in FIG. 3.

As shown in FIG. 4, lever 42 extends downwardly from rod 32. Tie-rods 44 extend from each end of lever 42 to flanges 46 associated with each wheel 50.

Figure 5:
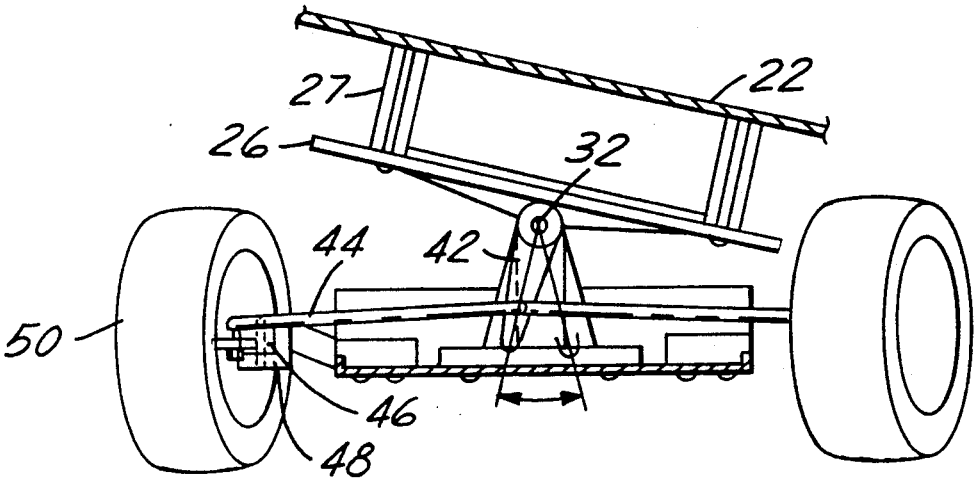
FIG. 5 is a view similar to FIG. 4, but showing turning of the vehicle.

As shown in FIG. 5, plate 26 is connected by bosses 27 to an underside of vehicle cab 22. Vehicle cab 22 is shown forced downwardly to the right in this figure. As shown, lever 42 has rotated in the opposite direction to cause the wheels to turn to the position shown in FIG. 1.

Figure 6:
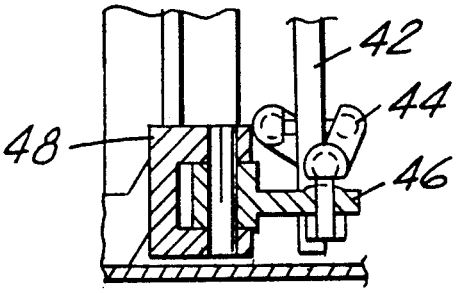
FIG. 6 is a cross-sectional view along line 6—6 as show in FIG. 2.

As shown in FIG. 6, lever 42 is connected to tie-rods 44 by ball and socket universal joints. Tie-rods 44 are connected to flanges 46 by similar ball and socket joints. Flanges 46 are pivotally received within brackets 48. The universal joints accommodate the different axes of movement between lever 42 and flange 46, allowing easy movement of wheels 50.

Figure 7:
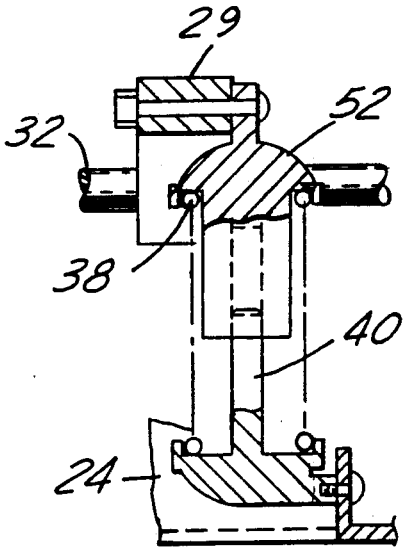
FIG. 7 is a cross-sectional view along line 7—7 as shown in FIG. 2.

As shown in FIG. 7, member 52 is slidably received on rod 40 which is fixed to base 24. Plate 29 pivots relative to member 52, since member 52 must adjust on rod 40.

A preferred embodiment of the present invention has been disclosed, however, one of ordinary skill in the art would recognize that certain modifications would come within the scope of this invention. For that reason the following claims should be studied in order to determine the true scope and content of this invention.

I claim:

1. A toy vehicle comprising:

an elongated base supporting a pair of wheels at a front longitudinal position, and at least one wheel at a rear longitudinal position, said wheels at said front longitudinal position being steerable;

a plurality of support bearings spaced longitudinally along and mounted to said elongated base, each of said support bearings having an upwardly positioned portion with an aperture;

an elongated shaft member, said elongated shaft member extending along a longitudinal axis through said support bearing apertures and being rotatably mounted thereto, said elongated shaft member being free to rotate about said longitudinal axis through at least a limited rotational extent;

a lever attached to said elongated shaft member at said front longitudinal position such that said lever and said elongated shaft member rotate together;

a steering mechanism for each of said wheels at said front longitudinal position, said steering mechanism being connected to said lever;

a plurality of plates spaced along said longitudinal axis, each of said plates having a downwardly positioned portion with an aperture that is aligned with said support bearing apertures, and through which said elongated shaft member extends and is mounted thereon such that said plurality of plates and said elongated shaft member rotate together relative to said elongated base;

at least one coil spring disposed between said elongated base and one of said plates whereby said coil spring exerts a biasing force against said one plate which biases said elongated shaft member to bias said lever toward a neutral position vertically downwardly from said elongated shaft member such that said wheels at said front longitudinal position are centered to cause the vehicle to move in a straight path; and a cab positioned above said elongated base, said cab being connected to said plurality of plates, said cab being positioned vertically above said elongated shaft member when said lever is in said neutral position such that when said cab is rotated downwardly to the right of said longitudinal axis, said lever rotates upwardly and to the left of said longitudinal axis such that said wheels are moved to cause the vehicle to turn in a corresponding direction, and said cab, when rotated downwardly to the left of said longitudinal axis, said lever rotates upwardly to the right of said longitudinal axis such that said wheels are moved to cause the vehicle to turn in an opposite direction.

2. The toy vehicle as recited in claim 1, wherein said steering mechanism comprises:

a pair of tie-rod ends connected to said lever by a first pair of universal joints, wherein one of said pair of tie-rod ends is positioned forwardly of said lever, and the other of said pair of tie-rod ends is positioned rearwardly of said lever; and a pair of flanges connected to said pair of tie-rod ends by a second pair of universal joints, said pair of flanges being pivotally received in brackets fixed to said elongated base, each of said pair of flanges pivoting with one of said pair of wheels at said front longitudinal position.

3. A vehicle comprising:

a base extending along a longitudinal axis, said base supporting a pair of wheels at a front longitudinal position, and at least one wheel at a rear longitudinal position, said wheels at said front longitudinal position being steerable;

a cab positioned above said base, said cab being free to rotate about said longitudinal axis relative to said base through at least a limited rotational extent;

an elongate member fixed to rotate with said cab, said elongate member being fixed to a lever, which is in turn connected to a steering mechanism for each of said wheels at said front longitudinal position, such that when a portion of said cab on a right lateral side of said longitudinal axis is rotated downwardly, said wheels are positioned to cause said vehicle to turn to the right, and when a portion of said cab on a left lateral side of said longitudinal axis is rotated downwardly, said wheels are positioned to cause said vehicle to turn to the left, said elongate member being connected to said cab by a plurality of plates spaced along said longitudinal axis;

wherein said cab is positioned vertically above said elongate member, and said lever extends vertically downwardly from said elongate member, said lever being at a neutral position where said wheels at said front longitudinal position are centered on said longitudinal axis, such that when said cab is rotated downwardly to the right of said longitudinal axis, said lever rotates upwardly and to the left of said longitudinal axis away from said neutral position, and when said cab is rotated downwardly to the left of said longitudinal axis said lever rotates upwardly to the right of said longitudinal axis away from said neutral position, and said lever being connected to said wheels at said front longitudinal location such that said wheels are moved to cause said vehicle to turn in the desired direction; and wherein at least one coil spring is disposed between said base and one of said plurality of plates whereby said coil spring exerts a bias force against said plate to bias said lever toward said neutral position.

4. A vehicle as recited in claim 1, wherein said plates have bosses which are connected to an underside of said cab.

5. A vehicle as recited in claim 1, wherein bearings are mounted on said base, and rotatably support said elongate member.

6. A vehicle as recited in claim 1, wherein said lever is connected to a pair of tie-rods which are connected to flanges, each of which pivot with one of said wheels at said front longitudinal position.

7. A vehicle as recited in claim 6, wherein said flanges are pivotally received in brackets fixed to said base.

8. A vehicle as recited in claim 7, wherein one of said pair of tie-rods is positioned forwardly of said lever, and one of said pair of tie-rods is positioned rearwardly of said lever.

9. A vehicle as recited in claim 6, wherein said tie-rods are connected to said lever and said flange by universal joints.

10. A vehicle as recited in claim 1, wherein said bias force is provided by a pair of coil spring spaced about said longitudinal axis, and a plate fixed to said elongate member, said plate compressing one of said coil springs when said cab is moved downwardly to the right or to the left, and upon removal of the force said compressed coil spring returning said plate to the centered position.

11. A vehicle as recited in claim 1, wherein a bias force returns said lever to a position such that said wheel at said front longitudinal position are centered on said longitudinal axis.

12. A vehicle comprising:

a base extending along a longitudinal axis, said base supporting a pair of wheels at a front longitudinal position, and at least one wheel at a rear longitudinal position, said wheels at said front longitudinal position being steerable;

a cab positioned above said base, said cab being free to rotate about said longitudinal axis relative to said base through at least a limited rotational extent;

an elongate member fixed to rotate with said cab, said elongate member being connected to said cab by a plurality of plates spaced along said longitudinal axis, said elongate member being fixed to a lever, which is in turn connected to a steering mechanism for each of said wheels at said front longitudinal position, such that when a portion of said cab on a right lateral side of said longitudinal axis is rotated downwardly, said wheels are positioned to cause said vehicle to turn to the right, and when a portion of said cab on a left lateral side of said longitudinal axis is rotated downwardly, said wheels are positioned to cause said vehicle to turn to the left;

said cab being positioned vertically above said elongate member, and said lever extends vertically downwardly from said elongate member, said lever being at a neutral position where said wheels at said front longitudinal position are centered on said longitudinal axis, such that when said cab is rotated downwardly to the right of said longitudinal axis, said lever rotates upwardly and to the left of said longitudinal axis away from said neutral position, and when said cab is rotated downwardly to the left of said longitudinal axis said lever rotates upwardly to the right of said longitudinal axis away from said neutral position, and said lever being connected to said wheels at said front longitudinal location such that said wheels are moved to cause said vehicle to turn in the desired direction;

said lever being directly connected to a pair of tie-rods which are connected to flanges, each of which pivot with one of said wheels at said front longitudinal position, said tie-rods are connected to said lever and said flanges by universal joints:

wherein at least one coil spring is disposed between said base and one of said plurality of plates whereby said coil spring exerts a bias force against said plate to bias said lever toward said neutral position.

* * * * *